United States Patent [19]

Klint

[11] 3,958,206

[45] May 18, 1976

[54] CHEMICALLY AUGMENTED ELECTRICAL FUSE

[75] Inventor: Robert V. Klint, Rexford, N.Y.

[73] Assignee: General Electric Company, Schenectady, N.Y.

[22] Filed: June 12, 1975

[21] Appl. No.: 586,286

[52] U.S. Cl. ..... 337/406; 337/160; 337/296; 337/401; 337/405

[51] Int. Cl.[2] ..... H01H 37/76

[58] Field of Search ..... 337/30, 142, 160, 243, 337/295, 296, 401, 404, 405

[56] References Cited

UNITED STATES PATENTS

| | | | |
|---|---|---|---|
| 2,305,436 | 12/1942 | McMorris | 337/30 |
| 2,892,062 | 6/1959 | Bruckner et al. | 337/290 |
| 3,184,726 | 5/1965 | Hellgren | 337/243 X |
| 3,377,448 | 4/1968 | Baumbach | 337/401 |
| 3,851,219 | 11/1974 | Kozorezov | 337/30 X |

FOREIGN PATENTS OR APPLICATIONS

| | | | |
|---|---|---|---|
| 772,748 | 11/1967 | Canada | 337/405 |

*Primary Examiner*—J. D. Miller
*Assistant Examiner*—Fred E. Bell
*Attorney, Agent, or Firm*—Donald R. Campbell; Joseph T. Cohen; Jerome C. Squillaro

[57] ABSTRACT

A conventional fusible element is combined with exothermic reactive material such as PETN or a ribbon of aluminum-palladium to supply quickly released chemical energy for fast circuit interruption where the circuit-derived electrical energy available for interruption is low. An arc quenching substance preferably surrounds the fusible element. The exothermic reaction is initiated thermally or by supplementary electrical energy from a trigger circuit.

10 Claims, 7 Drawing Figures

CHEMICALLY AUGMENTED ELECTRICAL FUSE

BACKGROUND OF THE INVENTION

This invention relates to fuses used for interrupting electrical circuits, and more particularly to chemically augmented fuses to obtain high speed operation at circuit current levels that are relatively close to the steady-state current so that only a small amount of energy is available to quickly rupture a conventional fusible element.

Electrical fuses are essential protective devices in a large variety of products. As the power and current ratings of such equipment increase often accompanied by a more compact design, the demands on the protective fuses also increase. In equipment with power semiconductor devices, for example, fuses are being called on to operate continuously at higher steady-state currents while the times to clear the fault are being reduced. This results in less energy available above steady-state heating to quickly rupture the fusible element. Failure to interrupt the circuit quickly before excessive current levels are reached can result in damaging or destroying the solid state components.

SUMMARY OF THE INVENTION

In accordance with the invention, a chemically augmented fuse employs a conventional fusible element, typically made of silver, with which is combined an exothermic reactive material to supply quickly released chemical energy for fast circuit interruption. The preferred exothermic reactive materials are shock resistant diluted PETN (pentaerythritol tetranitrate) and aluminum-palladium reactive solid. Initiation of the exothermic reaction can be achieved thermally, but circuit interruption occurs more rapidly or at lower current levels by addition of a trigger circuit to supply supplementary electrical energy across a localized portion of the reactive material in response to sensing an excessive current level. To reduce the clearing time, an arc quenching substance is added to the fuse filling the space between the insulating tube and fusible element. In view of the added chemical or chemical and electrical energy, fast circuit interruption is achieved at excessive current levels relatively close to the steady-state current with low amounts of circuit-derived electrical energy.

In one embodiment, a tubular fusible element is flattened at each end to encase a slug of diluted PETN, and a solid granular material such as zeolite with adsorbed $SF_6$ or other electro-negative gas is used to quench the arc. In another embodiment, a ribbon of aluminum-palladium is bonded to the fusible element by an insulating layer and the fuse can be filled with oil for arc quenching at higher currents. The trigger circuit employing a current sensor, triode type switch and small battery is used in either form for fast initiation of the exothermic reaction.

DESCRIPTION OF THE PREFERRED EMBODIMENTS

Figure 1:
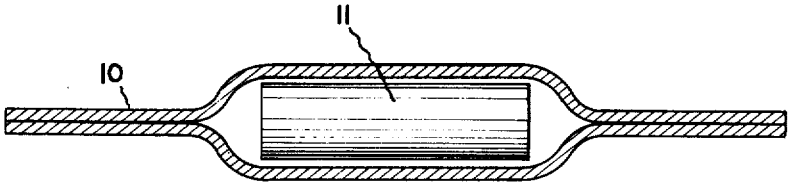
FIG. 1 is a partial cross-sectional view through a tubular fusible element formed to encase a slug of PETN exothermic reactive material.
Figure 2:
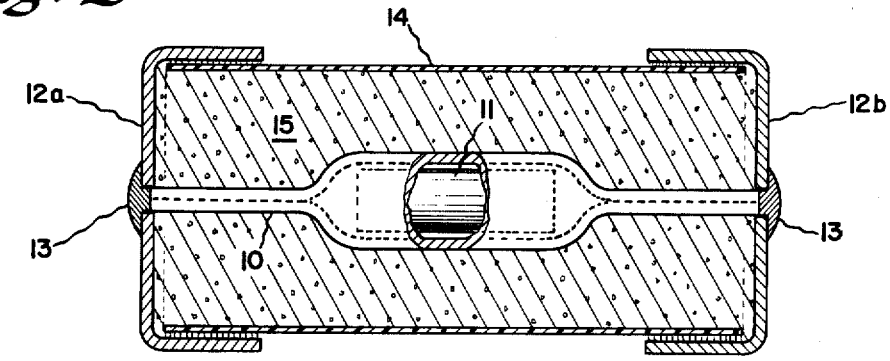
FIG. 2 is a cross section partially in plan view of a chemically augmented fuse according to one embodiment of the invention using the fusible element shown in FIG. 1 and surrounding solid material with adsorbed arc quenching gas.
Figure 3:
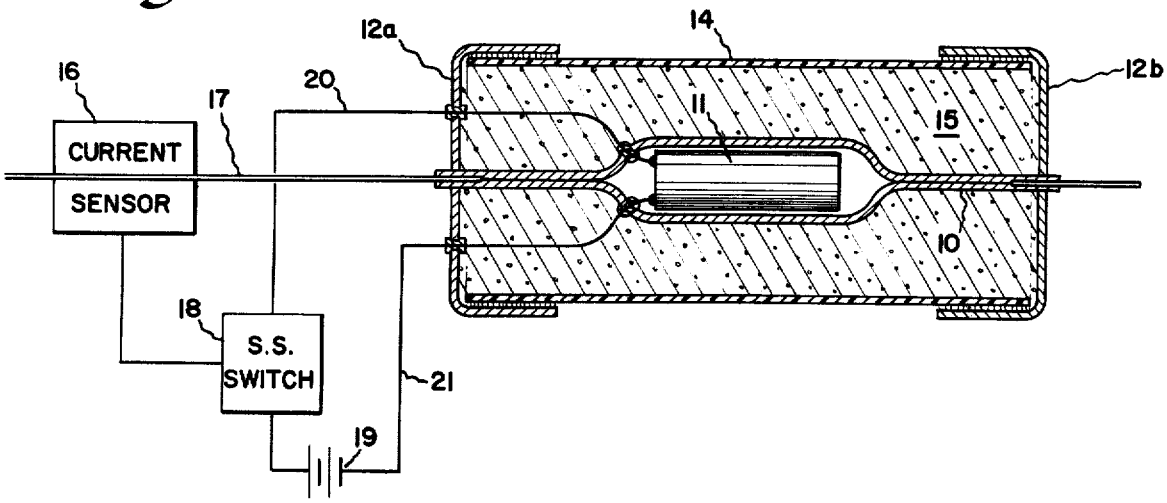
FIG. 3 is a cross-sectional view of a modification of FIG. 2 wherein the fuse is equipped with a trigger circuit for more rapid interruption.

In the form of the chemically augmented fuse shown in FIGS. 1–3, a slug of pentaerythritol tetranitrate (PETN) is employed in combination with a conventional fusible element to provide quickly released chemical energy for effecting more rapid rupture than would occur with only the usual resistive heating of the fusible element. The fusible element 10 is preferably of a tubular construction into which the slug 11 of diluted PETN is inserted before flattening each end so as to encase the slug. The fusible element further is made of silver or a silver alloy commonly used for this application. PETN, also known as penthrite, is selected in preference to other known explosives because it is shock resistant, has combustion rates up to 8,000 meters per second, and is available in this form commercially. As is evident, the slug 11 is in good thermal relationship with the tubular central portion of the fusible element 10.

In the fuse construction illustrated in FIG. 2 by way of example, the flattened ends of fusible element 10 are respectively inserted through correspondingly shaped openings in a pair of metal ferrules 12*a* and 12*b*, and mechanically and electrically connected together by solder joints 13. Soldering is desirably used when there is sufficient distance to the slug 11 of diluted PETN so that no problem is created by the heating. A surrounding insulating tube 14 typically made of glass cloth or paper material is glued or otherwise fastened to the insides of the two opposing ferrules. The remaining space inside insulating tube 14 is substantially filled with solid granular material having an adsorbed arc quenching electro-negative gas which is liberated by the heat of the exothermic reaction and is effective to reduce the clearing time. Sulfur hexafluoride, $SF_6$, is advantageous for this purpose and can be adsorbed in a granulated zeolite material.

In a simple chemically augmented fuse relying on thermal initiation of the exothermic reaction, a predetermined excessive circuit current level, but significantly lower than the current that would cause melting of the fusible element, heats the tubular central portion of fusible element 10 and thus also slug 11 of the diluted PETN to a sufficiently high temperature to cause the reaction. A small explosion occurs, rupturing the fusible element and generating heat. Obviously, the amount of silica or other diluent mixed with the PETN material, as is known in the art, is adjusted so that the resulting explosive reaction is small. Depending upon the current level, an arc may be developed between the separated portions of the fusible element which must be extinguished before circuit interruption is complete. As was mentioned, the heat generated by the exothermic reaction liberates the adsorbed $SF_6$ gas from the treated granular zeolite 15 and helps to quench the arc, thereby decreasing the clearing time.

More rapid circuit interruption or interruption at lower fault currents is achieved by the addition of the trigger circuit shown in FIG. 3 for supplying supplementary electrical energy to the exothermic reactive material upon the sensing of a predetermined excessive current level. Conventional components and a small dry cell type battery can be used in constructing the trigger circuit, which is shown in block diagram form. A suitable current sensor 16 senses the current in fusible element 10 either directly or in a conductor 17 in series with fuse, and generates a sensor signal preferably in the form of a varying voltage that is supplied to the base drive or gating circuit of a fast acting triode type solid state switch 18. Suitable gating circuits for an SCR switch, for example, are described in "The SCR Manual" published by the General Electric Company, 5th Edition, Copyright 1972. Solid state switch 18 and a small battery 19 or other source of electrical energy are connected in series to discharge the supplementary electrical energy through a localized portion of the slug 11 of diluted PETN. In the illustrated arrangement, a pair of small wires 20 and 21 extend through holes in one ferrule 12*a* and in the end walls of the tubular central portion of the fusible element, the ends of the wires being attached to the end of slug 11 spaced from one another. Upon the sensing of a predetermined excessive current level, switch 18 is rendered conductive and the battery discharges sufficient electrical energy to heat up the end of slug 11 to the temperature at which the exothermic reaction is initiated and propagates throughout the slug of diluted PETN.

Figure 4:
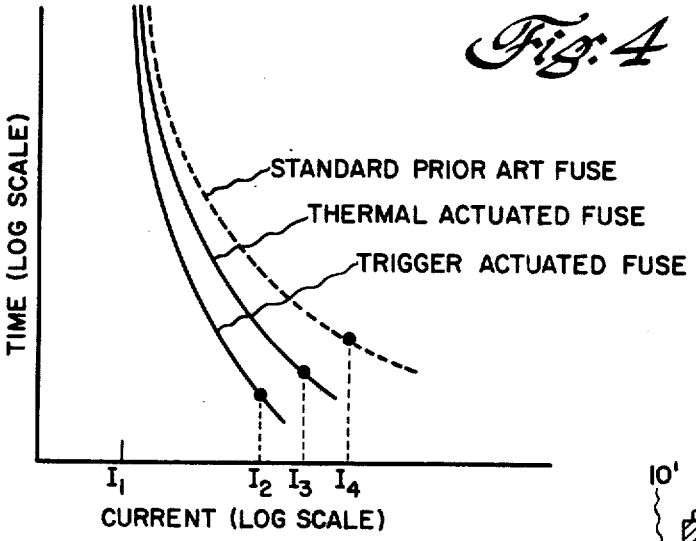
FIG. 4 shows several current-time characteristics to facilitate explanation of the trigger circuit.

The current-time characteristics in FIG. 4 depict in a general manner the more rapid circuit interruption, or interruption at lower fault currents, realized by the addition of a supplementary trigger circuit. Assuming that current $I_1$ is the mean steady-state current, $I_2$ is the current at interruption using trigger circuit actuation as compared to the higher current $I_3$ at interruption relying on only thermal actuation of the exothermic reactive material. The much higher current $I_4$ by way of reference is the fault current at interruption due to resistive heating of a standard prior art fuse to the melting temperature. Consequently, it is seen that the chemically augmented fuse is advantageous in those applications, such as the protection of semiconductor devices in solid state equipment, where fast circuit interruption is required at current levels relatively close to the steady-state current such that the available amount of circuit-derived electrical energy to provide resistive heating in the fusible element is relatively low.

Figure 5:
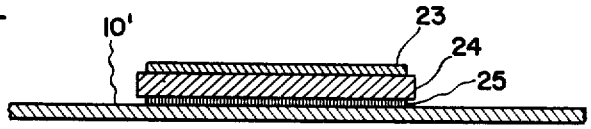
FIG. 5 is a partial cross section through a flat fusible element with added aluminum-palladium exothermic reactive material.
Figure 6:
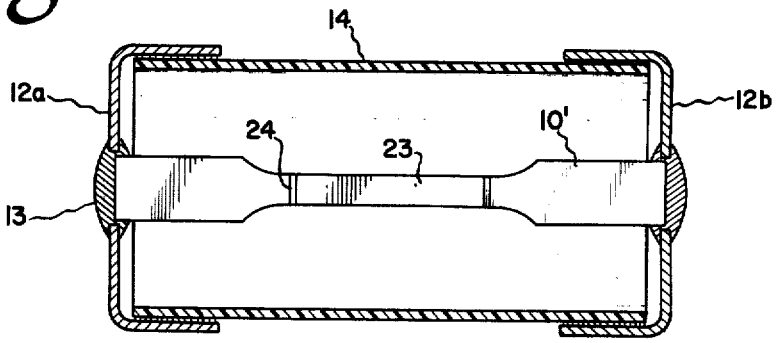
FIG. 6 is a cross section partially in plan view of a fuse according to a second embodiment using the fusible element shown in FIG. 5.
Figure 7:
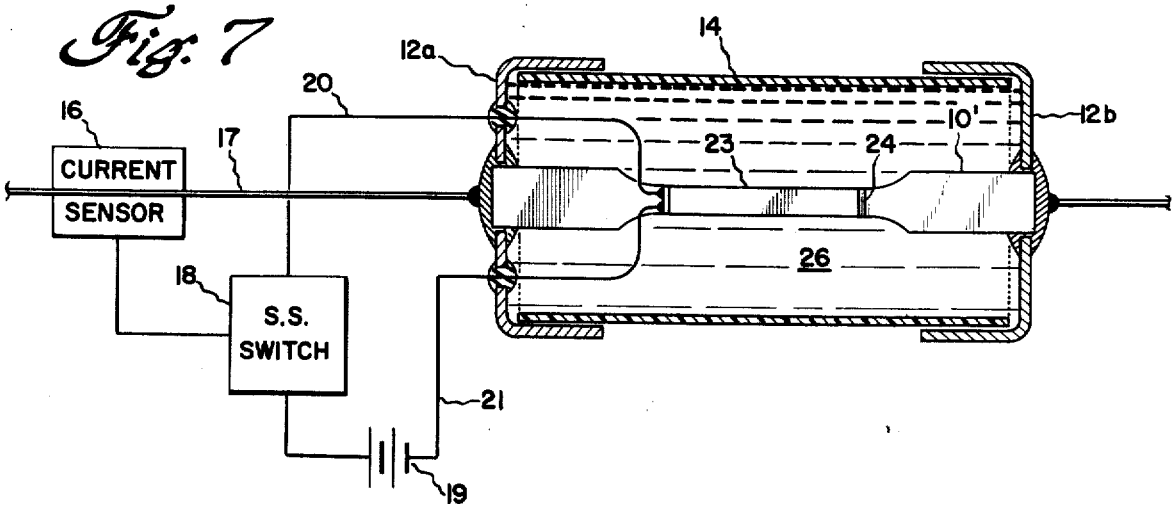
FIG. 7 is similar to FIG. 6 but is modified to include the trigger circuit for more rapid interruption.

The second form of the chemically augmented fuse shown in FIGS. 5–7 employs a reactive solid, in particular intimately joined overlying layers of aluminum and palladium, as the exothermic reactive material. The fusible element 10' is provided in ribbon form and desirably has a reduced width central portion to which the aluminum-palladium sandwich is bonded by a high temperature insulating layer. Preferably the thin palladium layer 23 is on the outside, although this is not essential, and the aluminum layer 24 has a thickness three times greater than that of the palladium. A thin insulating layer 25 with good thermal conductivity such as a filled expoxy bonds the reactive sandwich to the silver or silver alloy fusible element. The construction of the fuse if similar to that already described with regard to FIG. 2, with the exception that at lower currents an arc quenching substance is not needed.

When heated to a sufficiently high temperature, as is known in the art, the exothermic reaction that results is described by the equation $Pd + 3Al \rightarrow PdAl_3$, where $PdAl_3$ is a solid. The temperature at which this reaction is initiated, of course, is substantially lower than the melting temperature fo the fusible element. The whipping usually induced by this exothermic reaction ruptures the fusible element and results in circuit interruption at low currents. Operation at higher currents can take place in insulating oil to assist arc quenching. FIG. 7 illustrates the addition of the trigger circuit for faster action or interruption at lower currents. In a manner similar to that shown in FIG. 3, the trigger circuit wires 20 and 21 are fastened in spaced relation to one end surface of the aluminum-palladium sandwich 23, 24. At the predetermined excessive circuit current level, switch 18 is closed and supplementary electrical energy from battery 19 causes localized resistive heating in one end of the aluminum-palladium sandwich, thereby initiating the exothermic reaction which results in rupture of the fuse. FIG. 7 also illustrates the addition of insulating oil 26 in the space between insulating tube 14 and the modified fusible element to help quench the arc.

Although the trigger circuit is illustrated exterior to the fuse, it will be understood that a micro-miniaturized sensing circuit together with the solid state switch may be installed in one of the fuse ferrules or other mounting means for the insulating tube and fusible element. Within the broader scope of the invention the chemically augmented fuse may be constructed in cartridge type form as is here disclosed or in various other fuse configurations such as with knife blade extensions for plugging into a fuse box.

While the invention has been particularly shown and described with reference to several preferred embodiments thereof, it will be understood by those skilled in the art that the foregoing and other changes in form and details may be made therein without departing from the spirit and scope of the invention.

The invention claimed is:

1. An electrical fuse for fast circuit interruption with low amounts of circuit-derived electrical energy at current levels above the steady-state current comprising an elongated conductive fusible element having an exothermic reactive material carried by the central portion thereof, mounting means connected to each end of said fusible element and supporting a surrounding insulating tube, and a trigger circuit for initiating rapid circuit interruption comprising means for effectively sensing the current in said fusible element, and circuit means responsive to the sensing of a predetermined excessive current level for discharging supplementary electrical energy through a localized portion of said exothermic reactive material to initiate the exothermic reaction.

2. A fuse according to claim 1 further including an arc quenching substance substantially filling the space between said insulating tube and fusible element.

3. An electrical fuse for fast circuit inerruption with low amounts of available circuit-derived electrical energy comprising an elongated conductive fusible element encasing a slug of diluted pentaerythritol tetranitrate, mounting means connected to each end of said fusible element and supporting a surrounding insulating tube, and a solid material having an adsorbed arc quenching electro-negative gas and substantially filling the space between said fusible element and insulating tube, said adsorbed gas being liberated upon rapid exothermic reaction of said pentaerythritol tetranitrate due to excessive current levels in said fusible element to obtain fast circuit interruption.

4. A fuse according to claim 3 wherein said solid material having adsorbed arc quenching gas is a granular zeolite material with adsorbed sulfur hexafluoride.

5. A fuse according to claim 3 further including a trigger circuit for initiating more rapid circuit interruption and comprising means for effectively sensing the current in said fusible element, a source of electrical energy, switch means rendered conductive by the sensing of a predetermined excessive current level, and means for connecting said switch means and source of electrical energy in series to discharge across a localized portion of said slug of diluted pentaerythritol tetranitrate.

6. A fuse according to claim 3 wherein said solid material having adsorbed arc quenching gas is a granular zeolite material with adsorbed sulfur hexafluoride, and further including a trigger circuit for initiating more rapid circuit interruption comprising means for effectively sensing the current in said fusible element, and circuit means responsive to the sensing of a predetermined excessive current level for discharging supplementary electrical energy through a localized portion of said slug of diluted pentaerythritol tetranitrate.

7. An electrical fuse for fast circuit interruption with low mounts of available circuit-derived electrical energy comprising an elongated conductive fusible element having a ribbon of aluminum-palladium reactive solid bonded thereto by an insulating layer, and mounting means connected to each end of said fusible element and supporting a surrounding insulating tube, said ribbon of aluminum-palladium having a rapid exothermic reaction in response to excessive current levels in said fusible element to obtain fast circuit interruption.

8. A fuse according to claim 7 further including a trigger circuit for initiating more rapid circuit interruption and comprising means for effectively sensing the current in said fusible element, a source of electrical energy, switch means rendered conductive by the sensing of a predetermined excessive current level, and means for connecting said switch means and source of electrical energy in series to discharge across a localized portion of said aluminum-palladium ribbon.

9. A fuse according to claim 8 wherein the fuse is substantially filled with arc quenching insulating oil.

10. A fuse according to claim 7 wherein the fuse is substantially filled with arc quenching insulating oil, and further includes a trigger circuit initiating initiatin more rapid circuit interruption comprising means for effectively sensing the current in said fusible element, and circuit means responsive to the sensing of a predetermined excessive current level for discharging supplementary electrical energy through a localized portion of said aluminum-palladium ribbon.

* * * * *